US006488244B2

(12) United States Patent
Ruan et al.

(10) Patent No.: US 6,488,244 B2
(45) Date of Patent: Dec. 3, 2002

(54) TYPING SUPPORT

(75) Inventors: Ying Gang Ruan, 12014 W. 130th St., Overland Park, KS (US) 66213; Joy Wei Ruan, Overland Park, KS (US)

(73) Assignee: Ying Gang Ruan, Overland Park, KS (US)

( * ) Notice: Subject to any disclaimer, the term of this patent is extended or adjusted under 35 U.S.C. 154(b) by 0 days.

(21) Appl. No.: 09/779,289

(22) Filed: Feb. 8, 2001

(65) Prior Publication Data

US 2002/0117589 A1 Aug. 29, 2002

(51) Int. Cl.[7] ..... B43L 15/00

(52) U.S. Cl. ..... 248/118.1; 248/118.3; 248/442.2

(58) Field of Search ..... 248/118.1, 118.3, 248/447, 454, 442.2, 918

(56) References Cited

U.S. PATENT DOCUMENTS

| | | | | | |
|---|---|---|---|---|---|
| 607,675 | A | * | 7/1898 | Barr | |
| 5,004,196 | A | * | 4/1991 | Gross | 248/118.3 |
| 5,108,057 | A | * | 4/1992 | Dandy, III et al. | 248/118 |
| 5,183,230 | A | * | 2/1993 | Walker et al. | 248/118 |
| 5,320,317 | A | * | 6/1994 | Hyatt | 248/118.1 |
| 5,386,957 | A | * | 2/1995 | Miller | 248/118.5 |
| 5,398,896 | A | * | 3/1995 | Terbrack | 248/118.5 |
| D357,910 | S | * | 5/1995 | Newhouse | D14/114 |
| 5,507,458 | A | * | 4/1996 | Campbell et al. | 248/118.3 |
| 5,713,544 | A | * | 2/1998 | Wolf et al. | 248/118 |
| D399,194 | S | * | 10/1998 | Chuang | D14/114 |
| D415,745 | S | * | 10/1999 | Clark | D14/114 |
| 5,992,810 | A | * | 11/1999 | Crinion et al. | 248/284.1 |
| 6,082,684 | A | * | 7/2000 | Chuang | 248/118.5 |
| 6,142,570 | A | * | 11/2000 | Bergsten et al. | 297/411.35 |
| 6,203,109 | B1 | * | 3/2001 | Bergsten et al. | 297/411.35 |
| 6,247,672 | B1 | * | 6/2001 | Bello | 248/118.1 |
| 6,257,531 | B1 | * | 7/2001 | Penner | 248/118 |
| 6,293,508 | B1 | * | 9/2001 | Kochanski et al. | 248/298.1 |

* cited by examiner

*Primary Examiner*—Leslie A. Braun
*Assistant Examiner*—Ingrid Weinhold
(74) *Attorney, Agent, or Firm*—Hovey Williams LLP

(57) ABSTRACT

A typing support is provided as a part of a typing station including a keyboard. The typing support includes a frame having a track and a keyboard support for engagement with a keyboard, a pair of wrist supports, and mounting members on which the wrist supports are carried. The mounting members provide support for the wrists of the typist which allow pivotal movement of one and preferably both hands during typing, and also translational movement along the longitudinal axis of the track. At least one of the wrist supports may be retained in a stationary position relative to the track by a retainer. The relative height or inclination of the keyboard can be adjusted by adjustment feet. The keyboard support may include a support member which pivots relative to a base to adjust the height of the keyboard received thereon, and may also keep a sheet of paper or the like in an upright position for viewing during typing.

11 Claims, 4 Drawing Sheets

10
12
46
42
44
18
30
136
138
140
136
38
56
36
52
14
24

54
46
42
26
44
16

62
84
96
12
28
58
68
70
64
60
80
90
92
86
76
88
78
60
66
70
82
96
14
52
10

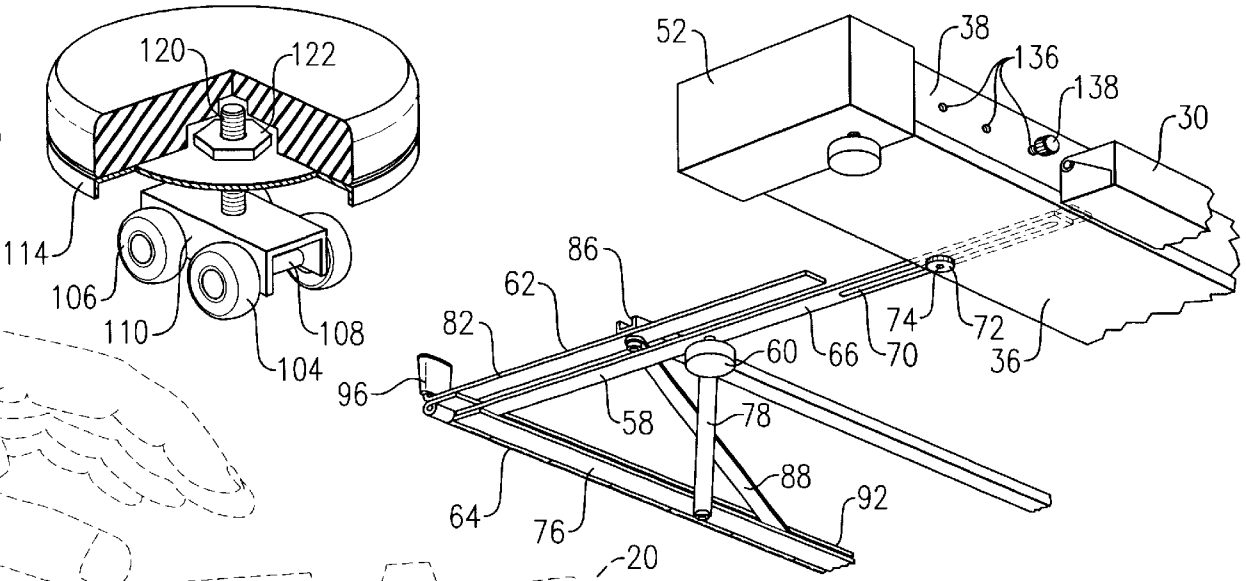
FIG. 7
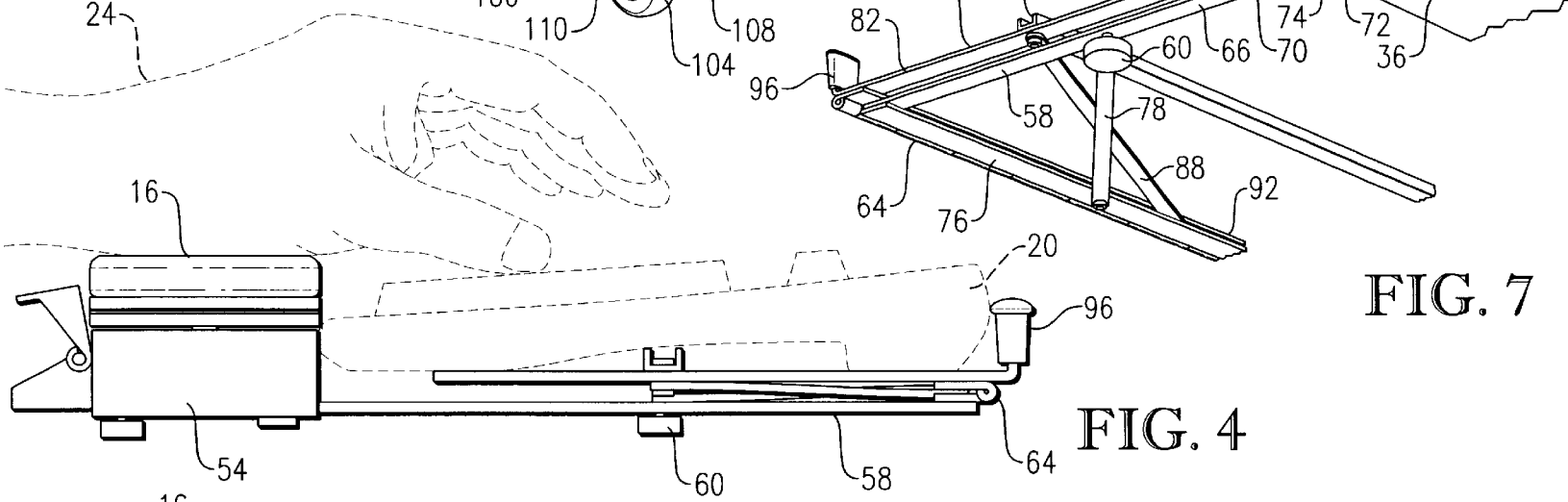
FIG. 4
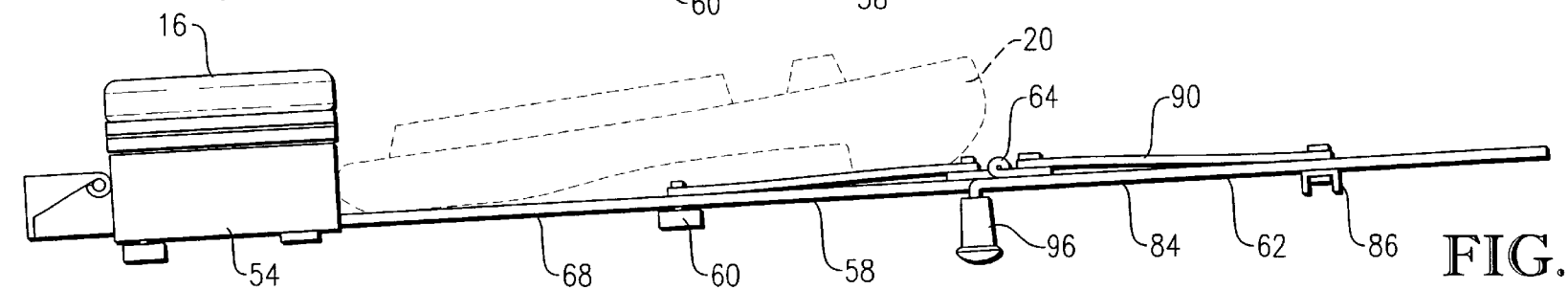
FIG. 3
FIG. 8

TYPING SUPPORT

BACKGROUND OF THE INVENTION

1. Field of the Invention

This invention broadly concerns an ergonomic typing support for shiftably supporting the wrists during typing. More particularly, it is concerned with a typing support having at least one, and more preferably two, independent wrist supports which are mounted to a frame for pivoting and most preferably translation during typing. The typing support is adapted to be combined with a keyboard and used with a mouse to provide an ergonomic typing station.

2. Description of the Prior Art

Typing on a keyboard can be a fatiguing task when conducted over an extended period. In the past, a typist was required to support his or her wrists by arm strength alone when typing at a typewriter. The emergence of the personal computer has made the use of a keyboard an everyday task for a much broader group of people. Typing is performed over an extended period with the result that some individuals may suffer from carpal tunnel syndrome attributed to repetitive tasks.

As a result, different approaches have been developed for supporting the typist's hands while at the keyboard. Typically, such devices are a fixed pad or wrist support on which the typist can place the wrists adjacent the keyboard. However, such pads or supports are fixed in place relative to the keyboard, and do not follow the user's hand motions during work. In addition, many typists may make keyboard entries from a standing or semi-standing, rather than a sitting position, and the use of conventional pads do not support the wrists in these positions. It is especially important that a support be simple, economical and easy to use with conventional keyboards such as computer keyboards. There has thus developed a need for a more ergonomic support which accommodates different users and different positions, as well as permitting support which shifts with the movement of the user's wrists during typing.

SUMMARY OF THE INVENTION

These and other objects of the present invention have largely been met by the typing support with shiftable wrist support in accordance with the present invention. That is to say, the typing support hereof provides continuous wrist support while the user's hands move to alternative keyboard positions. Moreover, it is simple and economical, requiring no external power sources, readily receives existing keyboards, and in preferred embodiments, may be adjusted for different heights and enables the wrist support to be shifted either rotationally or translationally, or alternatively fixed against translation.

Broadly speaking, the typing support of the present invention includes a frame which carries one and preferably a pair of wrist supports and mounting members which shiftably mounts the wrist supports to the frame. The mounting members enable the wrist supports to be pivoted relative to the frame, but in the preferred embodiment, the mounting structure also enables the wrist supports to translate relative to the frame, and most preferably to adjust the height of the wrist supports relative to the frame. To this end, the frame includes a track along which the wrist supports may move, the track being of sufficient length relative to the length of the keyboard to enable the user to position at least one of the wrist supports so that the user's fingers reach all of the keys with one or the other hand without lifting a wrist from either of the supports. Moreover, the frame most preferably provides for adjustment of the inclination of the keyboard received thereon relative to the track, and may provide a hinged support member for holding a sheet behind the keyboard for easy viewing while typing.

The mounting members carry the wrist supports thereon. The mounting members are received by the track and guided therealong by one or a pair of guide rails. The support members may include a wheeled carriage, or alternatively a ball or other friction resistant members which follow along the track. A retainer may be provided to selectively hold the mounting members against translational movement relative to the track, such that a desired location for one hand of the typist can be maintained while the other hand is supported by the other wrist support as it moves along the track. The mounting members may accommodate vertical adjustment of the wrist supports relative to the track by, for example, an upright threaded stud coupled to the wrist support, whereby rotation of the wrist support adjusts the height of the wrist support.

These and other advantages will be readily apparent to those skilled in the art with reference to the drawings and detailed description which follow.

BRIEF DESCRIPTION OF THE DRAWINGS

FIG. 3 is a side elevational view of the typing support hereof with the support member in a fully extended position showing the resultant inclination of the keyboard;

FIG. 4 is a side elevational view of the typing support similar to FIG. 3, but with the support member in a retracted position;

FIG. 7 is a fragmentary perspective view showing arms providing adjustable connection bet the track and a base for enabling adjustment of the track toward and away from the keyboard to accommodate different hand sizes of typists;

FIG. 8 is an enlarged view of an alternative embodiment of the wrist support and mounting member for permitting vertical adjustment of the wrist support relative to the track;

DESCRIPTION OF THE PREFERRED EMBODIMENT

Figures 2, 6:
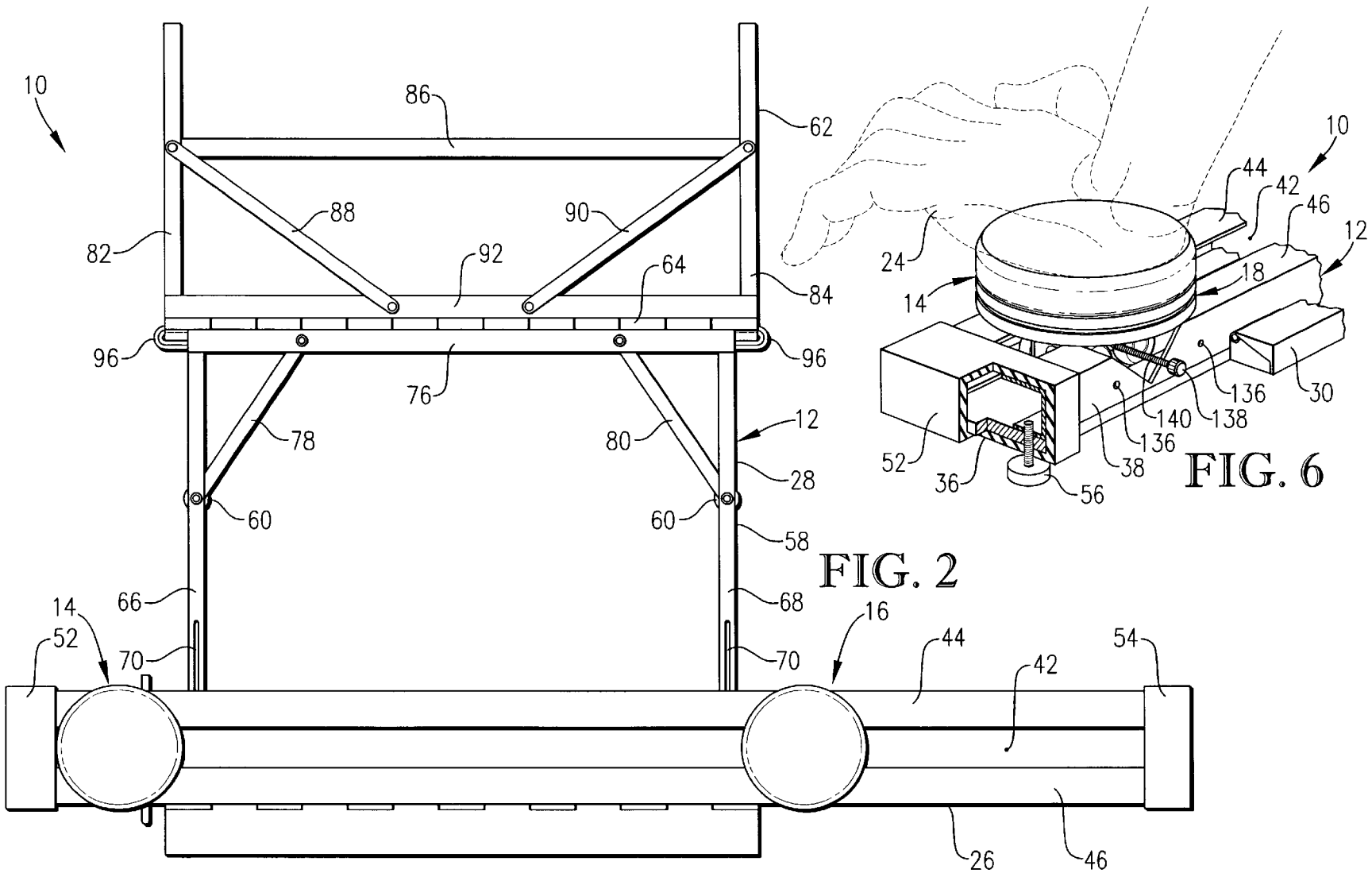
FIG. 2 is a top plan view thereof, showing a hinged support member in a fully extended position to vary the inclination of the keyboard relative to the frame.
FIG. 6 is an enlarged, fragmentary perspective view in partial section of the wrist support and frame with a portion of the front wall of the track cut away to show a set screw for retaining the wrist support and mounting member against translation.

Referring now to the drawings, a typing support 10 in accordance with the present invention broadly includes a frame 12 and a pair of wrist supports 14 and 16, the wrist supports being shiftably mounted relative to the frame 12 by a mounting member 18 provided for each wrist support. The typing support 10 is adapted for use with a keyboard, such as computer keyboard 20, and a computer mouse 22, to provide a typing station 23 which permits the hands 24 of the user to remain positioned on the wrist supports 14 and 16 while typing or manipulating the mouse 22 when it is positioned adjacent the keyboard 20 as shown in FIGS. 4 and 6, regardless of whether the user's forearms are substantially horizontal when in a sitting position as shown in FIG. 4, or in a generally upright orientation when standing as shown in FIG. 6.

Figures 1, 5:
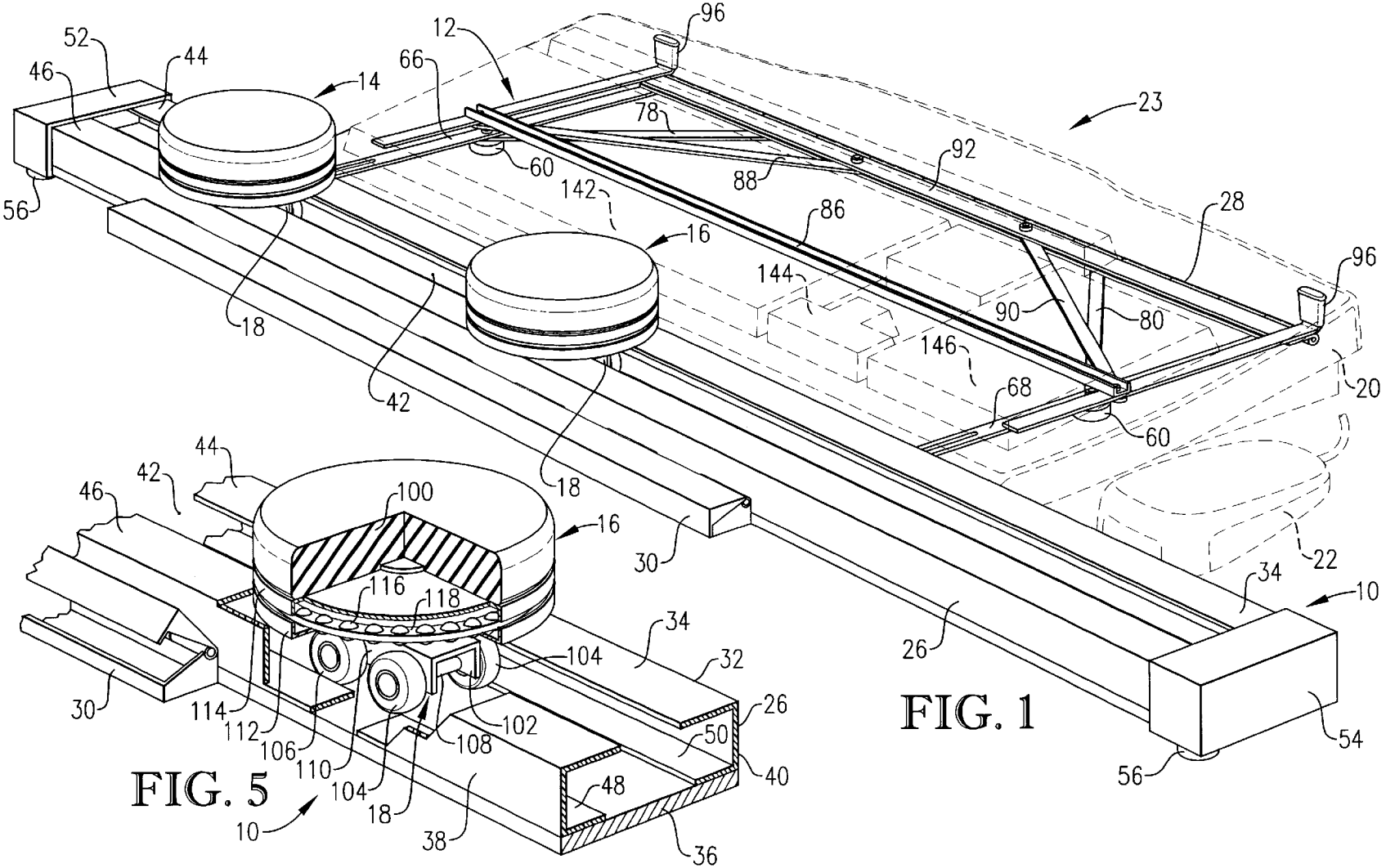
FIG. 1 is a perspective view of the typing support in accordance with the present invention with a keyboard and computer mouse to provide a typing station, the keyboard and mouse being shown in phantom lines for clarity.
FIG. 5 is an enlarged, fragmentary perspective view in partial section of the typing support showing a wrist support and its respective mounting member for enabling pivotal and translational movement of the wrist support along the track of the frame.

In greater detail, frame 12 includes an elongated track 26 and a keyboard support 28, and may include accessories such as a box 30 coupled to the front side of the track 26 for receiving pens, pencils or the like therein. As shown in FIG. 5, the track 26 may be provided as an elongated tubular channel 32 having a top wall 34, a bottom wall 36, a front wall 38 and a back wall 40, the top wall 34 including a longitudinally extending slot 42 to provide spaced-apart top surfaces 44 and 46. The slot 42 is coincident with and generally defines the longitudinal axis of the track 26. As shown in FIG. 5, the bottom wall 36 may include a pair of longitudinally extending guide rails 48 and 50. Caps 52 and 54 are preferably provided at the ends of the channel 32, the caps being removable to permit insertion of the mounting structure 18 partially within the channel 32. The slot 42 and the top surfaces 44 and 46 preferably extend at least the full length of the keyboard 20, and thus is sized complemental to a keyboard received on the keyboard support 28. Most preferably, when a computer keyboard 28 is used, the slot 42 and surfaces 44 and 46 extend an additional distance to permit the users hands 24 to remain on the wrist supports while manipulating the computer mouse 22. The track further includes a pair of padded feet 56 which are threadably connected to the bottom wall 36 and one of caps 52 and 54 as shown in FIG. 6 to advantageously both permit adjustment of the height of the frame 12 at its forward end and couple the caps 52 and 54 to the channel 32.

Figures 9, 10:
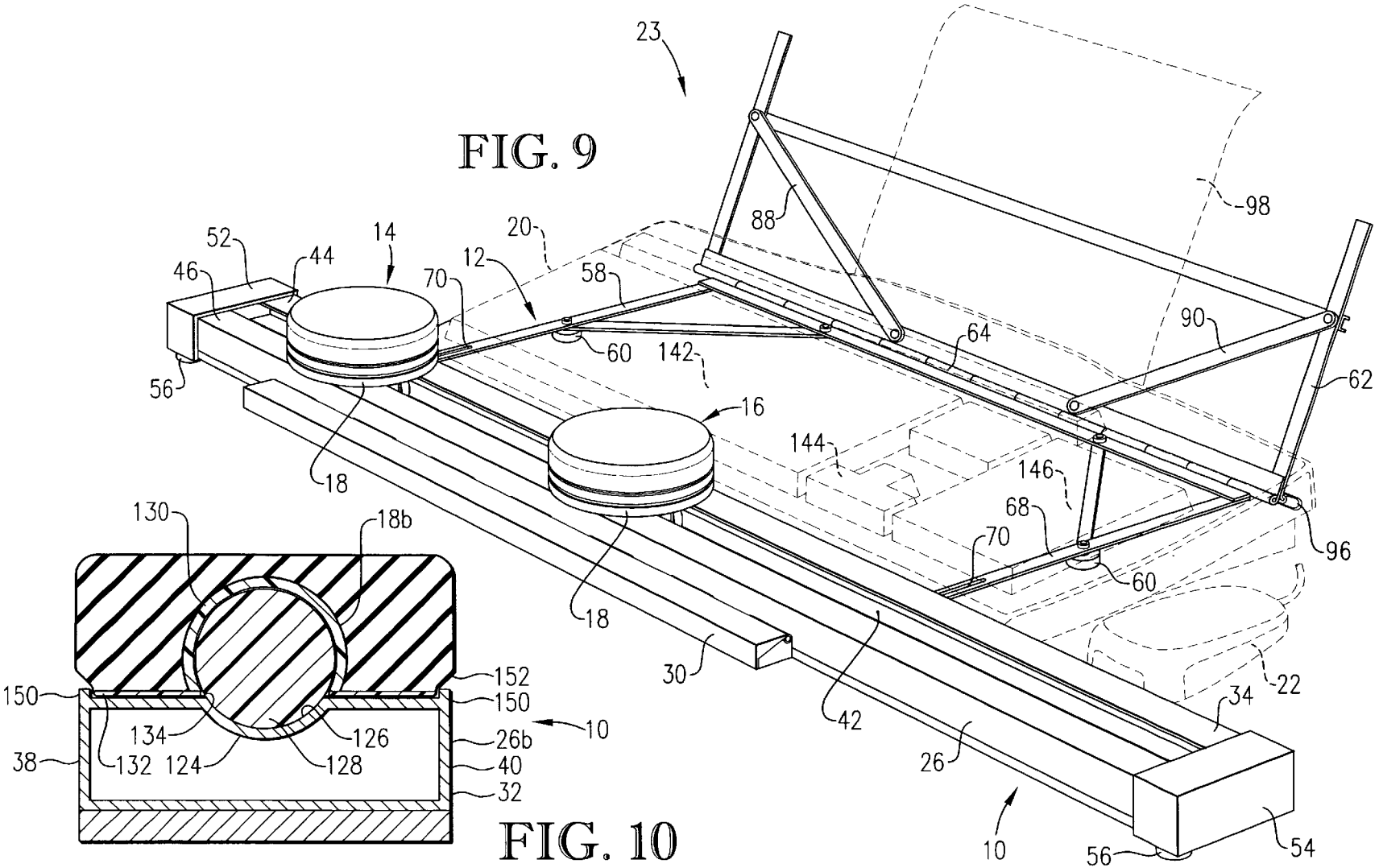
FIG. 9 is a perspective view of the wrist support of the present invention showing the hinged support member in an intermediate position for support a sheet of paper thereon, the she and a keyboard being shown in phantom for clarity.
FIG. 10 is an end elevational view of an alternate embodiment of the wrist support and track showing the use of a mounting member including a ball shiftably received relative to the track and the wrist support.

The keyboard support 28 includes a base 58 coupled to the track 26 and a support member 62 pivotally connected thereto by hinge 64. As shown in FIGS. 1, 2, 3, 4 and 7, the base 58 includes arms 66 and 68 which extend forwardly and adjustably connect to the track 26 by elongated openings 70 provided in each of the arms 66 and 68. A nut 72 is threaded onto a pin 74 which extends downwardly from the bottom wall 36 through each of the openings 70 to hold the track 26 in the desired position depending on the size of the user's hands 24, as shown in FIG. 7. The track 26 is thus permitted to be adjusted by moving it relative to the arms 66 and 68 and then tightening the nut 72 onto the pin 74. The base 58 further includes a back beam 76 and braces 78 and 80 which connect the back beam 76 to the arms 66 and 68 and help retain the keyboard 20 on the base 58. As shown in FIGS. 2, 3, 4 and 7, padded feet 60 are also threadably connected to the arms 66 and 68 to permit adjustment of the height of the base 58. The support member 62 includes legs 82 and 84, crossmember 86, diagonal braces 88 and 90, and bar member 92. The bar member 92 is pivotally connected to the back beam 76 by hinge 64. Legs 82 and 84 are L-shaped, each have a padded finger 96 which extends upwardly when the support member 62 is in a retracted position folded over the base 58 as shown in FIG. 4. The fingers extend downwardly to support the keyboard support 28 when the support member is fully extended as shown in FIG. 3, and extends diagonally as shown in FIG. 9 so as to, together with the frictional holding force of the hinge 64, retain the support member 62 in a generally upright position whereby a sheet 98 of paper or the like may be supported for viewing. In the sheet retaining position shown in FIG. 9, the weight of the base 58 and keyboard 20 along with the frictional resistance of the hinge together serve to overcome any moment caused by the inclination of the support member 62 from a vertical orientation. By positioning the support member in the retracted position shown in FIG. 3, the height of the keyboard 20 can be raised relative to the wrist supports as compared to the height of the keyboard 20 when the support member 62 is in either the extended or upright, sheet retaining positions.

The wrist supports 14 and 16 include padding 100 generally of a soft, elastomeric material such as natural or synthetic rubber to cushion the hands 24 of the user placed thereon, which may be covered by fabric if desired. As shown in FIG. 5, the mounting member 18 preferably provides for both rotational movement of the wrist supports 14 and 16 relative to the frame 12, as well as translational movement of the wrist supports longitudinally along the track 26. Various means for accomplishing this relative movement may be provided. In the embodiment shown in FIG. 5, mounting member 18 includes a wheeled carriage 102 having a pair of right wheels 104 and a pair of left wheels 106 each received on a respective axle 108 carried by a body 110. The body 110 is coupled to a lower plate 112, while the padding 100 is coupled to an upper plate 114. Ball bearings 116 held by a spacer plate 118 provide for relative rotational movement between the lower plate 112 and the upper plate 114. In addition, the wheels 104 and 106 are guided between the guide rails 48 and 50 to thereby permit the body 110, and therefore the wrist supports 14 and 16, to roll along the track 26. In an alternate embodiment of the mounting member 18*a* as shown in FIG. 8, an upright threaded stud 120 is coupled to and extends upwardly from the body 110. A nut 122 is fixed by adhesive, welding, soldering or the like to the upper plate 114 and threaded onto the stud 120 to permit both rotational movement of the wrist supports 14 and 16 relative to the frame 12, translational movement along the track 26, and vertical adjustment in the height of the wrist supports relative to the track 26 and thus the keyboard 20 received on the keyboard support 28.

In the embodiment of the mounting member 18b as shown in FIG. 10, the track 26*b* is modified such that slot 42 is provided by an elongated depressed U-shaped wall 124 defining a groove 126 in the top wall 34. The front wall 38 and back wall 40 each include normally upwardly extending flanges 150. The mounting member 18*b* includes a ball 128 rotatably received in a shell 130. The shell 130 extends downwardly more than a hemisphere, and a circular friction resistant plate 132 has an opening 134 smaller than the diameter of the ball 128 to retain the latter therein. The plate 132 may be of metal or more preferably a synthetic friction-resistant synthetic resin such as nylon, Delrin or Teflon. The outside diameter of the plate 132 is slightly smaller than the distance between the flanges 150 in the respective front and back walls in order to help retain the wrist supports therebetween. The ball 128 extends down into the groove 126 and permits the wrist supports 14 and 16 and the mounting structure 18*b* to rotate and translate along the groove 126. The circumscribing lower edge 152 of the wrist supports 14 and 16 is relieved to prevent binding of the cushioning material on the flanges 150 as the wrist supports 14 and 16 pivot and translate along the track. It may be appreciated that balls or rollers could be substituted for the wheels of the carriage 102, or H-shaped guides positioned in the slot between the top surfaces of the track instead of carriages, or other structures could be employed to provide the pivotal and translational movement obtained by the present invention.

The front wall 38 of the track 26 is preferably provided with a plurality of threaded holes 136 at longitudinally spaced intervals therealong. As illustrated in FIG. 6, retaining members 138, such as set screws having an elongated shank 140, may be placed through selected ones of the holes 136. The shank 140 is positioned between the right wheels 104 and the left wheels 106 of the wheeled carriage 102 of either of the mounting structures for the corresponding wrist supports 14 and 16 if the user desires to fix the wrist support against translational movement relative to the track 26 and thus the keyboard 20. This is especially desirable if the user has established a comfortable position for one or both hands with respect to use of, for example, the main keys 142 of the keyboard 20, and does not desire to slide one or even both hands along the keyboard if use of the auxiliary keys 144, calculator keys 146, or mouse 22 is infrequent. It may also be appreciated that for a left handed user, the keyboard 20 may be shifted to the right relative to the frame 12 and the mouse moved from the position shown in FIG. 1 to the left side of the keyboard 20, whereupon the right hand wrist support might be fixed by the retaining members 138 and the user would be free to move the wrist support 14 for the left hand along the track to access the mouse 22 without lifting the left hand from its wrist support 16.

In use, the keyboard 20 is placed on the keyboard support 28 so that the wrist supports 14 and 16 may slide along the track 26 and the typist's fingers may be positioned opposite the desired keys 142, 144 and 146, and the mouse is placed conveniently to the typist's right or left hand alongside the keyboard 20 and adjacent the track 26 to give ready access to the mouse 23 without the necessity of the typist's hand lifting from one or the other of the wrist supports 14 and 16. The typist's hands are placed with so that the heel of the hand 24 is supported on the wrist supports 14 and 16. The inclination of the keyboard 20 and its height may be adjusted by threading feet 56 and 60 upwardly or downwardly. Further height adjustment of the keyboard position may be made by extending or retracting the support member 62. The keyboard 20 may also be moved effectively toward or away from the track 26 and therefore the wrist supports 14 and 16 by loosening the nut 72 and sliding the legs 66 and 68 toward or away from the track 26. The relative height of the wrist supports 14 and 16 may be adjusted in the embodiment shown in FIG. 8 by rotating the wrist supports to move nut nut 122 upwardly or downwardly along the stud 120.

The mounting structure 18 for each wrist support 14 and 16 enables the typist's hands to move independently of one another and to remain supported by the wrist supports 14 and 16. Such motion includes both pivoting movement of the hands 24 to reach the keys on the keyboard 20 and to manipulate the mouse 22, but also to allow the hands 24 to glide along the track 26 while resting on the wrist supports. Beneficially, the wrist supports also help cushion the hands 24 when the typist is in a standing position, as illustrated in FIG. 6. By selectively inserting the retaining members 138 in a desired hole 136 to place the shank 140 between the pairs of wheels 104 and 106, either of the wrist supports can be inhibited against translation along the track 26 when one or both hands is to remain in a relatively fixed location along the keyboard 20. For example, wrist support 14 may be positioned in a desired location for the left hand of the typist and retained in that position by threading the retaining member 138 into a selected one of the holes 136 to place the shank 140 between the wheels 104 and 106. When so positioned, the wheeled carriage 102 is inhibited from moving longitudinally along the track 26, but the wrist support 14 is still free to pivot with the user's left hand 24 to reach the various keys ordinarily used by that hand. The retaining member 138 may be removed at any time to free that wrist support 14 to translate along the track 26 when desired. If the typist desires to have a sheet of paper within easy view behind the keyboard, the support member 62 may be pivoted about hinge 64 to the position shown in FIG. 9 and a sheet 98 of paper placed against the support member 62 which retains it in an upright orientation.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the track 26 can be variously configured with grooves, rails or raceways which extend longitudinally and receive a mounting structure complemental thereto, and various connectors such as ball and socket or simple shaft and bearing connectors may be employed by the mounting structure to permit pivoting movement of the wrist supports about a generally upright axis in addition to those disclosed herein.

The inventor hereby states his intent to rely on the Doctrine of Equivalents to determine and assess the reasonably fair scope of his invention as pertains to any apparatus not materially departing from but outside the literal scope of the invention as set out in the following claims.

What is claimed is:

1. A typing support comprising:

a frame including an elongated track and a keyboard support;

first and second mounting members received by said track for translational shifting along said track; and first and second wrist supports carried by said mounting members and pivotally coupled thereto, said keyboard support including a base, a support member, and a hinge pivotally coupling the support member relative to the base for movement between a first position with the support member folded over the base, a second position with the support member extended substantially coplaner relative to the base, and a third, generally upright position intermediate the first and second positions, whereby the first position allows a keyboard to rest on said support member, and the second and third positions allow said keyboard to rest on said base.

2. A typing support as set forth in claim 1, wherein said mounting members couple their respective said wrist supports for pivotal movement about a generally upright axis relative to said frame.

3. A typing support as set forth in claim 1, wherein said base includes arms adjustably connected to the track for permitting adjustment of the track toward and away from the base in a direction transverse to the longitudinal orientation of the track.

4. A typing support as set forth in claim 1, wherein said track is an elongated channel presenting a slot defining the longitudinal travel of said mounting members.

5. A typing support as set forth in claim 1, said support member including a pair of substantially parallel, spaced-apart legs, each of said legs including a finger for engaging a supporting surface to hold said support member at said third, generally upright position at an oblique angle relative to said base.

6. A typing support as set forth in claim 1, wherein each of said mounting members includes a wheeled carriage.

7. A typing support as set forth in claim 1, wherein each of said mounting members includes a height member for permitting adjustment of the height of the wrist supports relative to the mounting member.

8. A typing support as set forth in claim 2, wherein said track includes at least one elongated guide rail for guiding the movement of the mounting members along the track.

9. A typing support as set forth in claim 1, including a retainer for selectively inhibiting translational movement of one of the mounting members along the track.

10. A typing support as set forth in claim 1, including feet adjustably coupled to the frame for adjusting the height and inclination of the typing support.

11. A typing support as set forth in claim 1, said keyboard support including adjustment arms coupling the keyboard support to the track for permitting adjustment of the track generally toward and away from the keyboard support.

* * * * *